US011523695B2

(12) United States Patent
Fathollahi

(10) Patent No.: US 11,523,695 B2
(45) Date of Patent: Dec. 13, 2022

(54) STICKY NAPKIN AND TOWEL ROLL

(71) Applicant: Andrew William Fathollahi, Newport Beach, CA (US)

(72) Inventor: Andrew William Fathollahi, Newport Beach, CA (US)

( * ) Notice: Subject to any disclaimer, the term of this patent is extended or adjusted under 35 U.S.C. 154(b) by 0 days.

(21) Appl. No.: 17/125,081

(22) Filed: Dec. 17, 2020

(65) Prior Publication Data

US 2022/0346577 A1 Nov. 3, 2022

(51) Int. Cl.
*A47G 11/00* (2006.01)
*A47G 21/16* (2006.01)

(52) U.S. Cl.
CPC ..... *A47G 11/001* (2013.01); *A47G 11/002* (2013.01); *A47G 21/16* (2013.01); *A47G 2021/162* (2013.01); *Y10T 428/24231* (2015.01); *Y10T 428/24793* (2015.01)

(58) Field of Classification Search
None
See application file for complete search history.

(56) References Cited

U.S. PATENT DOCUMENTS

2013/0017362 A1* 1/2013 Barutcu ..... A47G 11/002 428/138

* cited by examiner

*Primary Examiner* — Alexander S Thomas
(74) *Attorney, Agent, or Firm* — Hackler Daghighian Martino & Novak

(57) ABSTRACT

A sticky napkin is disclosed. The sticky napkin includes a first surface and an opposing second surface, a first fold line extending from the first side to the second side, a second fold line extending from the first side to the second side, a first adhesive strip overlaying the second surface of the first end section panel and extending in a direction from the first side to the second side, and a second adhesive strip overlaying the second surface of the second end section panel and extending in a direction from the first side to the second side.

21 Claims, 12 Drawing Sheets

STICKY NAPKIN AND TOWEL ROLL

INCORPORATION BY REFERENCE TO RELATED APPLICATIONS

None.

TECHNICAL FIELD

The field of the invention relates to napkins and towel rolls, specifically to paper napkins and pre-perforated towel rolls with re-adherable adhesive regions that are capable of allowing the user to stick the napkin or a towel sheet to a surface.

BACKGROUND

Paper napkins and towels are commonly used in home, restaurant, and other places and settings in connection with dining, cleaning, absorption, etc. Advantageously, paper napkins and towels are disposable and relatively inexpensive as compared with napkins or towels made of textiles or other materials.

However, one problem recognized by the inventor here is that paper napkins and towels tend to be light-weight and can easily be displaced from their position by gravity or other forces, such as wind.

SUMMARY

Described herein is a sticky napkin and pre-perforated paper towel roll with one or more re-adherable low-tack pressure sensitive adhesive strips overlaying an outer surface of one or more regions thereof. Particular embodiments are disclosed.

Some embodiments are directed to a sticky napkin comprising a pre-folded paper napkin having a first surface and an opposing second surface with each surface defined by first, second, third and fourth sides, the first and second surfaces extending from a first end section panel to a second end section panel with a mid-section panel residing therebetween. The sticky napkin further comprises a first fold line extending from the first side to the second side and a second fold line extending from the first side to the second side. The first and second fold lines are spaced apart from one another with the first fold line separating the first end section panel from the mid-section panel of the napkin and the second fold line separating the second end section panel from the mid-section panel of the napkin. The first fold line is configured to bias the first end section panel to fold over the mid-section panel such that the first surface of the first end section panel is facing the first surface of the mid-section panel when folded. The second fold line is configured to bias the second end section panel to fold over the mid-section panel such that the first surface of the second end section panel is facing the surface of the mid-section panel when folded.

In some embodiments, a first adhesive strip overlays the second surface of the first end section panel and extends in a direction from the first side to the second side. A second adhesive strip overlays the second surface of the second end section panel and extends in a direction from the first side to the second side. An optional third adhesive strip overlays the second surface of the second end section panel and extends in a direction from the first side to the second side. The first, second, and third adhesive strips each are comprised of a re-adherable low-tack pressure sensitive adhesive.

In a first pre-folded state, the first adhesive strip adheres the second surface of the first end section panel to the first surface of the second end section panel. In this pre-folded statue, the second adhesive strip and third adhesive strip are configured to be capable of adhering to the second surface of the mid-section of a second pre-folded napkin adjacent thereto to form a stacked package of napkins with each napkin being adhered to the adjacent napkin in the stack. In an alternative pre-folded state, the second adhesive strip adheres the second surface of the second end section panel to the first surface of the first end section panel. Similarly, in this pre-folded state, the first adhesive strip and third adhesive strip are configured to be capable of adhering to the second surface of the mid-section of a second pre-folded napkin adjacent thereto to form a stacked package of napkins with each napkin being adhered to the adjacent napkin in the stack. While, the illustrated embodiment describes the use of three adhesive strips, it should be understood that more or less adhesive strips may be used. For example, in the foregoing pre-folded embodiments, it may be desirable that the pre-folded napkin have the first and second adhesive strips and not the third adhesive strip, or alternatively it may be desirable for the pre-folded napkin to have only the first, second, or third adhesive strips alone or in any combination In some embodiments, the first, second, third, and fourth sides define a square. In some embodiments, the first, second, third, and fourth sides define a rectangle. In some embodiments, the first, second and third adhesive strips have varying dimensions as compared to one another. In some embodiments, one or more of said first, second and third adhesive strips extend to said first and second sides. In some embodiments, one or more of said first, second and third adhesive strips do not extend to said first and second sides. In some embodiments, one or more of said first, second and third adhesive strips are comprised of series of discrete deposits of a re-adherable low-tack pressure sensitive adhesive that are spaced apart from one another. In some embodiments, the series of discrete deposits of a re-adherable low-tack pressure sensitive adhesive that are spaced apart from one another are comprised of circular shaped dots that are space apart from one another. In some embodiments, the series of discrete deposits of a re-adherable low-tack pressure sensitive adhesive that are spaced apart from one another are comprised of rectangularly shaped adhesive deposits that are space apart from one another. In some embodiments, the second and third adhesive strips of the sticky napkin contained within the package are adhered to the second surface of the mid-section panel of adjacent sticky napkin.

In some embodiments, the sticky napkin comprises a pre-folded paper napkin having a first surface and an opposing second surface with each surface defined by first, second, third and fourth sides, the first and second surfaces extending from a first end section panel to a second end section panel with a mid-section panel residing therebetween. The sticky napkin further comprises a first fold line extending from the first side to the second side and a second fold line extending from the first side to the second side. The first and second fold lines are spaced apart from one another, the first fold line separating the first end section panel from the mid-section panel of the napkin and the second fold line separating the second end section panel from the mid-section panel of the napkin. The first fold line is configured to bias the first end section panel to fold over the mid-section panel such that the first surface of the first end section panel is facing the first surface of the mid-section panel when folded. The second fold line is configured to bias the second end section panel to fold over the mid-section panel such that the first surface of the second end section panel is facing the surface of the mid-section panel when folded.

In some embodiments, a first adhesive strip overlays the second surface of the first end section panel and extends in a direction from the first side to the second side. A second adhesive strip overlays the second surface of the second end section panel and extends in a direction from the first side to the second side. The first and second adhesive strips each are comprised of a re-adherable low-tack pressure sensitive adhesive. In the pre-folded state, the first adhesive strip adheres the second surface of the first end section panel to the first surface of the second end section panel.

In some embodiments, the first, second, third, and fourth sides define a square. In some embodiments, the first, second, third, and fourth sides define a rectangle. In some embodiments, the first and second adhesive strips have varying dimensions as compared to one another. In some embodiments, one or more of said first and second adhesive strips extend to said first and second sides. In some embodiments, one or more of said first and second adhesive strips do not extend to said first and second sides. In some embodiments, one or more of said first and second adhesive strips are comprised of series of discrete deposits of a re-adherable low-tack pressure sensitive adhesive that are spaced apart from one another. In some embodiments, the series of discrete deposits of a re-adherable low-tack pressure sensitive adhesive that are spaced apart from one another are comprised of circular shaped dots that are space apart from one another. In some embodiments, the series of discrete deposits of a re-adherable low-tack pressure sensitive adhesive that are spaced apart from one another are comprised of rectangularly shaped adhesive deposits that are space apart from one another. In some embodiments, the second adhesive strip of the sticky napkin contained within the package is adhered to the second surface of the mid-section panel of an adjacent sticky napkin.

In some embodiments, a method of using a sticky napkin contained within a stacked package of pre-folded sticky napkins extending from a top sticky napkin to a bottom sticky napkin comprises the steps of: detaching the second surface of the mid-section panel of the top sticky napkin from the second and third adhesive strips of the underlying adjacent second surface of the second end section panel; unfolding the top sticky napkin along its second fold-line to separate the second end-section panel from the first adhesive strip on the first end section panel and away from the mid-section panel; unfolding the top sticky napkin along its first fold-line to separate the first end-section panel away from the mid-section panel; applying pressure to the sticky napkin against a surface to adhere the sticky napkin to that surface via one or more of the adhesive strips on the surface thereof; and removing the sticky napkin from the surface and disposing the napkin in a waste container.

In some embodiments, the napkin is pre-folded along a first fold line that extends from the first side to the second side and then along a second fold line that extends from the third side to the fourth side. One or more re-adherable low-tack pressure sensitive adhesive strips extend on the second or outer surface between the first side and second side. The one or more re-adherable low-tack pressure sensitive adhesive strips may be positioned between the first fold line and the third and/or fourth sides. In one implementation a single re-adherable low-tack pressure sensitive adhesive strips extends along the second surface immediately adjacent or in proximity to the edge of the third side from the first side to the second side. In another implementation a single re-adherable low-tack pressure sensitive adhesive strips extends along the second surface spaced from the edge of the third side and extends between the first and second sides. In another implementation a single re-adherable low-tack pressure sensitive adhesive strips extends along the second surface adjacent or in proximity to the edge of the first side from the first to the second side. In another implementation one or more re-adherable low-tack pressure sensitive adhesive strips extend along the second surface at the second side end region and extends from or between the first side to the second side. In another implementation one or more re-adherable low-tack pressure sensitive adhesive strips extend along the second surface at the third side end region and extends from or between the first side to the second side. In one implementation, the one or more re-adherable low-tack pressure sensitive adhesive strips extend atop the second surface between the first side end region and the second fold line. In another implementation, the one or more re-adherable low-tack pressure sensitive adhesive strips extend atop the second surface between the second side end region and the second fold line. In one implementation, the one or more re-adherable low-tack pressure sensitive adhesive strips do not extend over the second fold line.

Some embodiments are directed to a paper towel and paper towel roll implementation that includes one or more re-adherable low-tack pressure sensitive adhesive strips that extend along the trailing edge region of the paper sheet thereby mitigating against the paper towel roll unravelling while also providing an adhesive strip that is capable of allowing the user to adhere the separated sheet to another surface. The paper towel roll is generally comprised of a plurality of pre-perforated sheets, each sheet of which being comprised of a first surface and a second opposing surface and a free or leading edge and a trailing edge. When the sheets is part of the paper towel roll, the first surface faces the second surface of the underlying sheet. The trailing end region of each sheet includes one or more re-adherable low-tack pressure sensitive adhesive strips that extend between the opposing sides of the sheets adjacent or in proximity to the trailing edge of the sheet. In application, a user would grasp the leading or free edge of the sheet and perforate the sheet from the roll along the pre-perforated edge that extends between opposing sides of the sheet. In doing so, the one or more re-adherable low-tack pressure sensitive adhesive strips that extend near the trailing edge region adjacent or in proximity to the perforation line would be released from the underlying sheet to which it is adhered. Upon release, the user could then re-adhere the sheet to another surface by application of pressure to the opposing surface of one or more re-adherable low-tack pressure sensitive adhesive strips. Thus, the one or more re-adherable low-tack pressure sensitive adhesive strips positioned at or near the trailing edge of the sheet serve the dual purpose of keeping the paper roll from unraveling while also allowing the user to position a sheet the user has separated from the roll to a desired location.

Additional details regarding the various aspects of the subject matter described herein are set forth in the accompanying drawings and descriptions below and/or are otherwise apparent therefrom. It should be understood that the descriptions and illustrations herein, while illustrative of the various aspects of the disclosed subject matter, it is the claims that are intended to define the appropriate scope of the protected subject matter. It should be also understood that while aspects of the preferred implementations are described in terms by first, second, third and fourth designations, those designations are intended to be relative designations but otherwise should not limit.

BRIEF DESCRIPTION OF THE DRAWINGS

The accompanying drawings, which are incorporated in and constitute a part of this specification, illustrate certain aspects of the subject matter disclosed herein and together with the description, help explain aspects associated with the disclosed implementations. When practical, the same or similar reference numbers denote the same or similar structures, features, or elements.

The illustration depicts the re-adherable low-tack pressure sensitive adhesive strips facing upward. However, in application, the user may invert the stacked package so that the re-adherable low-tack pressure sensitive adhesive strips are facing downward, such that the user could peel-off the napkin on the top of the stack from the underlying napkin to which napkin is secured via the one or more re-adherable low-tack pressure sensitive adhesive strips.

DETAILED DESCRIPTION

Figure 1:
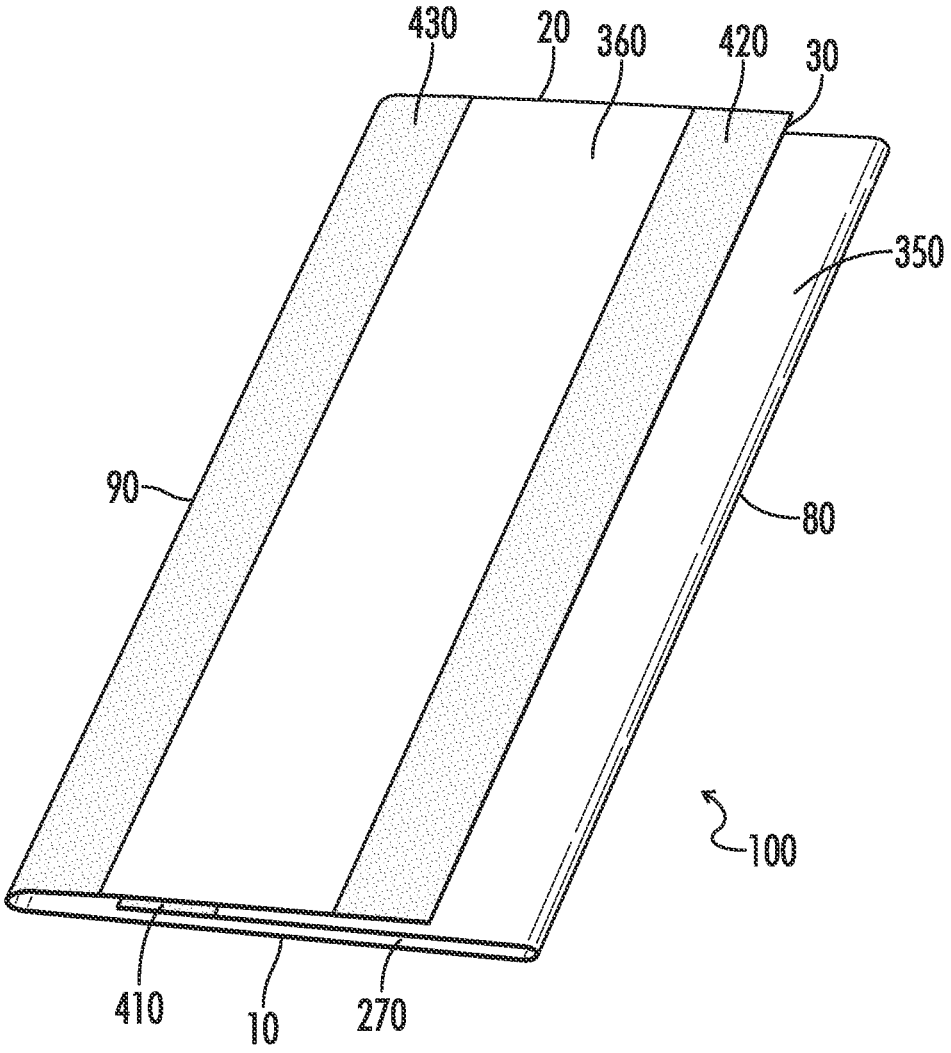
FIG. 1 is a perspective view of a sticky napkin in tri-folded position showing aspects thereof in accordance with the disclosed subject matter.
Figure 2:
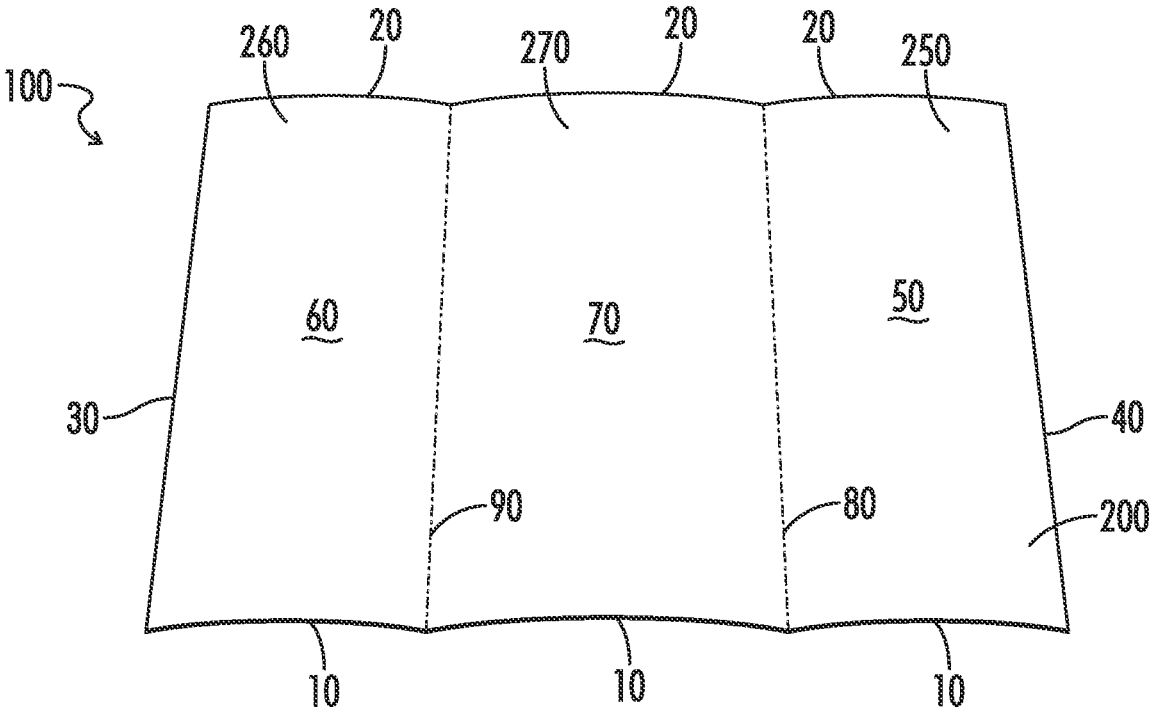
FIG. 2 is another perspective view of the sticky napkin of FIG. 1 with the sticky napkin unfolded to show the inner surface.

An exemplary sticky napkin 100 can be a paper napkin pre-folded in three folds as shown in FIG. 1. The exemplary sticky napkin 100 has an inner surface 200 defined by a first side 10, a second side 20, a third side 30 and a fourth side 40, as best shown in FIG. 2. The inner surface 200 can further extend from an inner surface 250 of a first end section panel 50 to an inner surface 260 of a second end section panel 60 with an inner surface 270 of a mid-section panel 70 residing therebetween.

Figure 3:
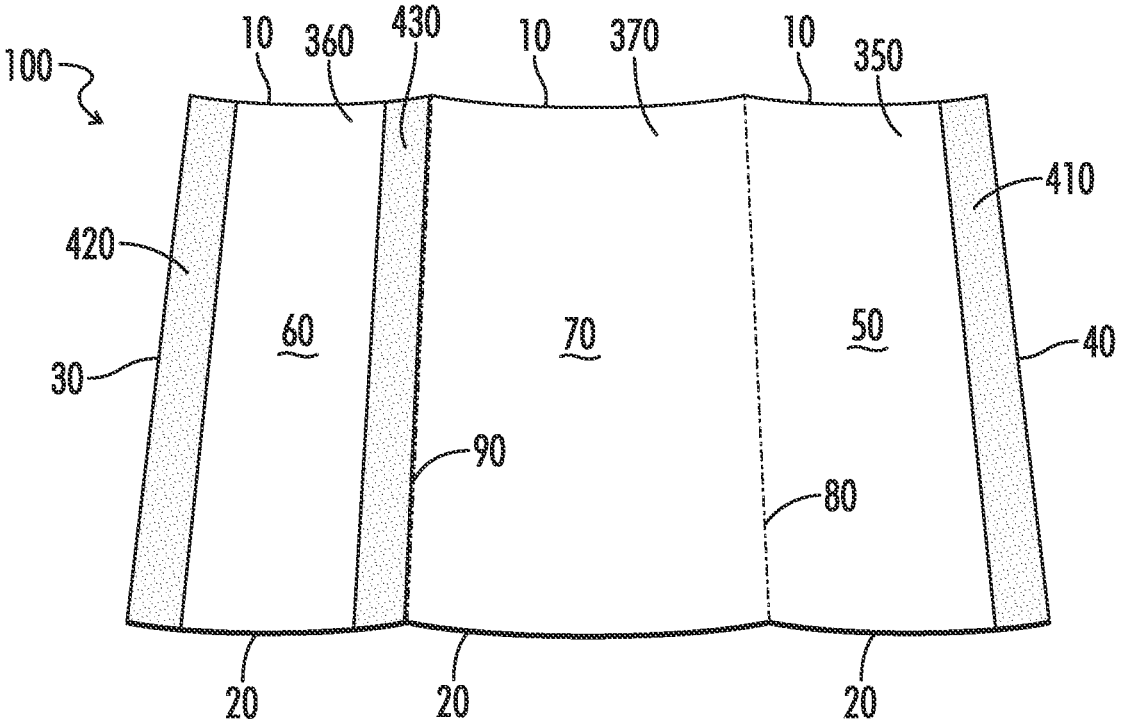
FIG. 3 is another perspective view of the sticky napkin of FIG. 1 with the sticky napkin unfolded to show the outer surface.

The exemplary sticky napkin 100 has an outer surface 300 that is opposing to the inner surface 200. The outer surface 300 can also be defined by the first side 10, the second side 20, the third side 30 and the fourth side 40, as best shown in FIG. 3. The outer surface 300 can further extend from an outer surface 350 of the first end section panel 50 to an outer surface 360 of the second end section panel 60 with an outer surface 370 of the mid-section panel 70 residing therebetween.

The sticky napkin 100 can comprise a first fold line 80 extending from the first side 10 to the second side 20. The sticky napkin 100 further comprises a second fold line 90 extending from the first side 10 to the second side 20. The first and second fold lines 80, 90 are spaced apart from one another with the first fold line 80 separating the first end section panel 50 from the mid-section panel 70 and the second fold line 90 separating the second end section panel 60 from the mid-section panel 70.

As best shown in FIG. 2, the first fold line 80 is configured to bias the first end section panel 50 to fold over the mid-section panel 70 such that the inner surface 250 of the first end section panel 50 is facing the inner surface 270 of the mid-section panel 70 when folded. The second fold line 90 is configured to bias the second end section panel 60 to fold over the mid-section panel 70 such that the inner surface 260 of the second end section panel 60 is facing the inner surface 270 of the mid-section panel 70 when folded.

A first adhesive strip 410 can overlay the outer surface 350 of the first end section panel 50 and extend in a direction from the first side 10 to the second side 20. A second adhesive strip 420 can overlay the outer surface 360 of the second end section panel 60 and extend in a direction from the first side 10 to the second side 10. An optional third adhesive strip 430 can overlay the outer surface 360 of the second end section panel 60 and extend in a direction from the first side 10 to the second side 10.

The first, second, and third adhesive strips 410, 420, 430 each can be comprised of a re-adherable low-tack pressure sensitive adhesive (PSA). The re-adherable low-tack pressure sensitive adhesive applied to adhesive strips 410, 420, 430 allow the outer surfaces 350, 360 to be easily attached to, removed from and even re-attached to other surfaces, e.g., paper, wood, metal, temporarily without lifting fibers or delaminating the sticky napkin 100. Details of pressure sensitive adhesive are described, for example, in U.S. Pat. No. 5,194,299 owned by Minnesota Mining and Manufacturing Company (3M), which is incorporated herein by reference in its entirety.

In a pre-folded state, as shown in FIG. 1, the first adhesive strip 410 adheres the outer surface 350 of the first end section panel 50 to the inner surface 260 of the second end section panel 60.

In some embodiments, the first side 10, second side 20, third side 30 and fourth side 40 define a contour of the sticky napkin 100 when the napkin is unfolded. In one embodiment, the contour of the sticky napkin 100 is a square. In another embodiment, the contour of the sticky napkin 100 is a rectangle.

In some embodiments, each of the first adhesive strip 410, second adhesive strip 420 and third adhesive strip 430 has varying dimensions as compared to one another. In some embodiments, one or more of the first, second and third adhesive strips 410, 420, 430 extend to the first and second sides 10, 20. In some embodiments, one or more of the first, second and third adhesive strips 410, 420, 430 do not extend to the first and second sides 10, 20.

In some embodiments, one or more of the first, second and third adhesive strips 410, 420, 430 are comprised of series of discrete deposits of a re-adherable low-tack pressure sensitive adhesive that are spaced apart from one another. In some embodiments, the series of discrete deposits of a re-adherable low-tack pressure sensitive adhesive that are spaced apart from one another are comprised of circular shaped dots that are space apart from one another. In some embodiments, the series of discrete deposits of a re-adherable low-tack pressure sensitive adhesive that are spaced apart from one another are comprised of rectangularly shaped adhesive deposits that are space apart from one another.

Figure 4:
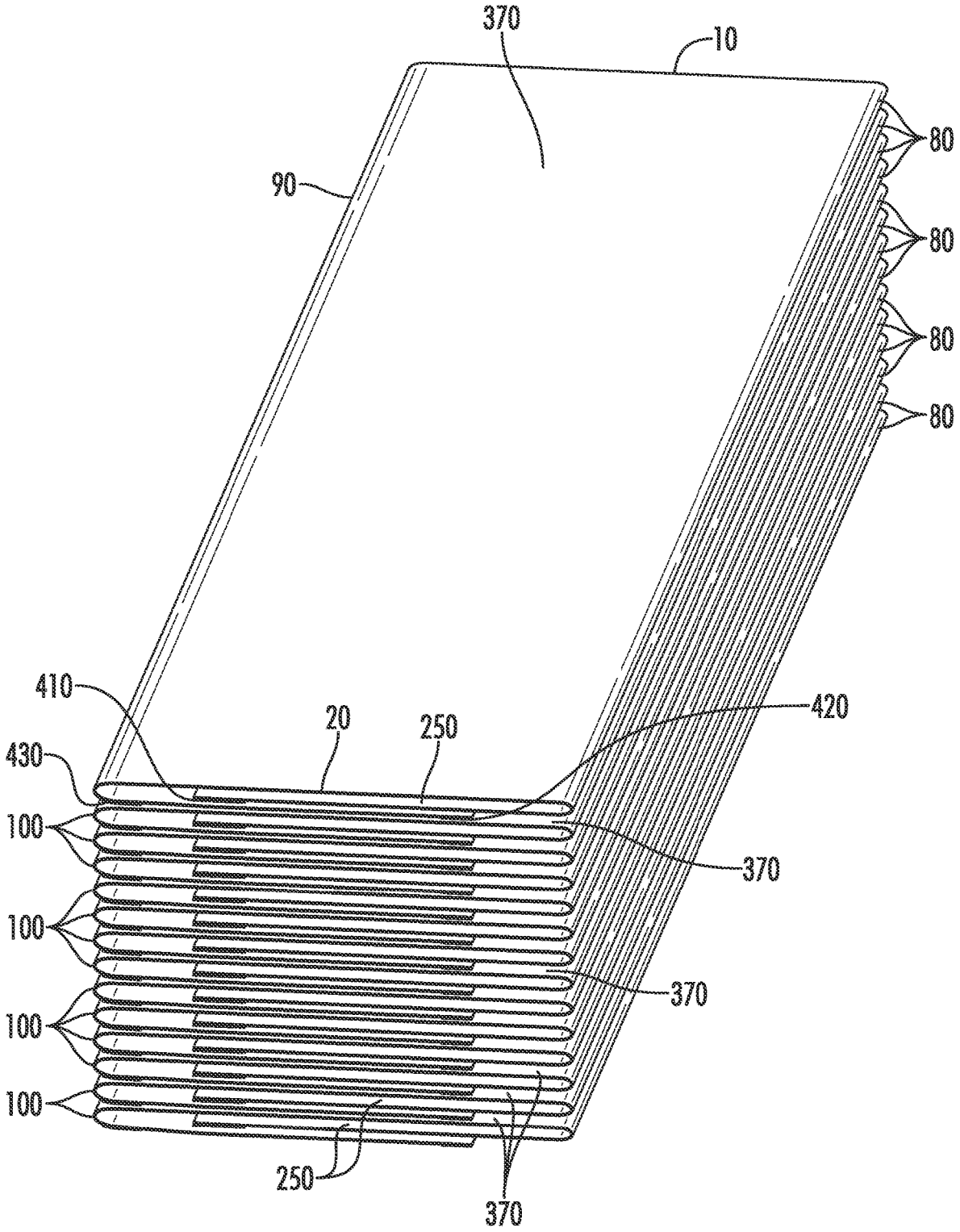
FIG. 4 is a perspective view of a stacked package of the sticky napkin of FIG. 1.

When the napkins are placed in as a stacked package as best shown in FIG. 4, in some embodiments, the second adhesive strip 420 of one sticky napkin contained within the package is adhered to the outer surface 370 of the mid-section panel 70 of an adjacent sticky napkin. In some embodiments, the second and third adhesive strips 420, 430 of one sticky napkin contained within the package are adhered to the outer surface 370 of the mid-section panel 70 of an adjacent sticky napkin.

In some embodiments, the sticky napkin 100 is formed by 2-ply papers. In some embodiments, the sticky napkin 100 is formed by 3-ply papers. In some embodiments, the sticky napkin 100 is formed by 4-ply papers. In some embodiments, the sticky napkin 100 is made of recycled material.

In operation, in some embodiments, the sticky napkin 100 contained within a stacked package of pre-folded sticky napkins extending from a top sticky napkin to a bottom sticky napkin (as best shown in FIG. 4) can be obtained by detaching the outer surface 370 of the mid-section panel 70 of the top sticky napkin 100 from the second adhesive strip 420 (or second and third adhesive strips 420, 430) of the underlying adjacent outer surface 360 of the second end section panel 60.

In some embodiments, the sticky napkin 100 can be unfolded by first unfolding the top sticky napkin 100 along its second fold-line 90 to separate the second end-section panel 60 from the first adhesive strip 410 on the first end section panel 50 and away from the mid-section panel 70, and then unfolding the top sticky napkin 100 along its first fold-line 80 to separate the first end-section panel 50 away from the mid-section panel 70.

In some embodiments, the sticky napkin 100 can be applied to an object or surface by applying pressure to the sticky napkin against the object or surface to adhere the sticky napkin 100 to that object or surface via one or more of the adhesive strips 410, 420, 430 on the object or surface thereof.

In some embodiments, the sticky napkin 100 attached to one object or surface can be removed from the object or surface by removing the sticky napkin 100 from the object or surface and disposing the napkin in a waste container. In some embodiments, the removed sticky napkin 100 can be reattached to the same object or surface or to a new object or surface.

Figure 5A:
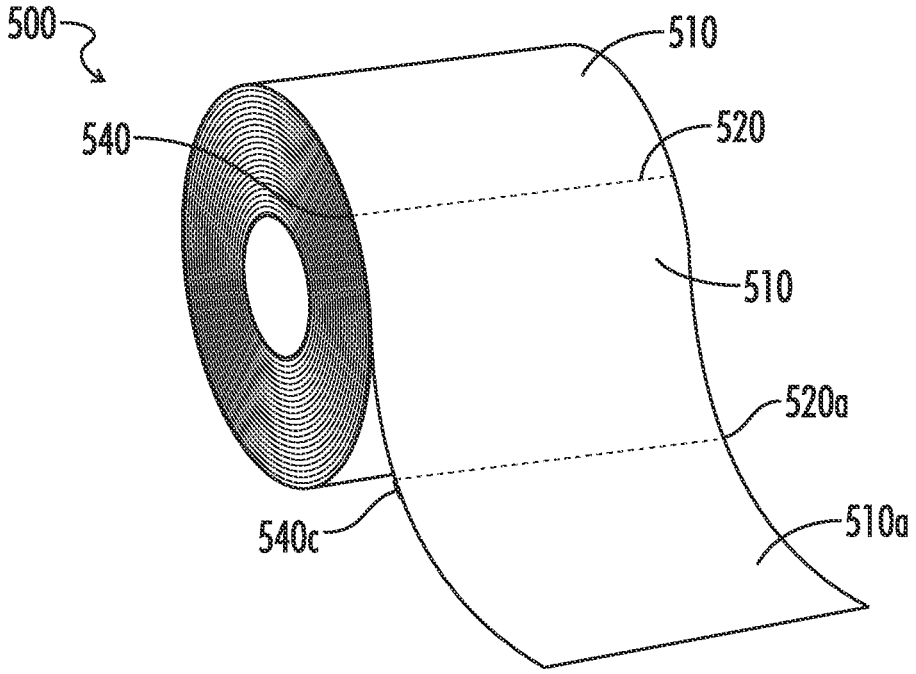
FIG. 5A is a perspective view of a pre-perforated paper roll in accordance with the disclosed subject matter, wherein the trailing edge of the sheets in the paper roll includes a re-adherable low-tack pressure sensitive adhesive strips that extends proximate to its trailing edge and that faces the underlying sheet in the roll.
Figure 5B:
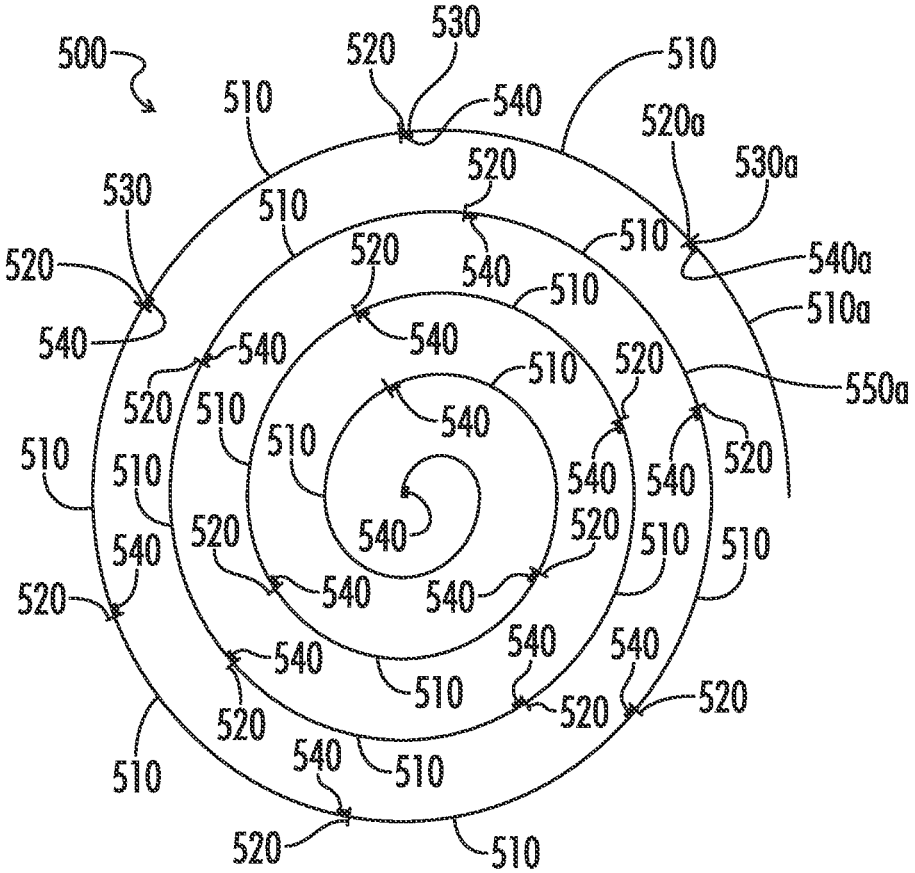
FIG. 5B is a cross-sectional schematic representation of the paper roll of FIG. 5A. The concentric circles represent the paper towel sheets connected together. The spaces between the sheets are for illustration purposes only. In application, the inward facing surface of the outer sheets together with the re-adherable low-tack pressure sensitive adhesive strips thereon would be in contact with the outer facing surfaces of the underlying sheets.

FIG. 5A is a perspective view of a paper roll 500 in accordance with the disclosed subject matter. FIG. 5B is a cross-sectional view of a portion of the paper roll 500 of FIG. 5A.

Referring to both FIG. 5A and FIG. 5B, the paper roll 500 comprises a plurality of designated sheets 510 separated by pre-perforated lines 520 that the plurality of designated sheets 510 form a long stripe that can be rolled into a roll for transportation, storage, use, etc. In a preferable embodiment, an inner side of the trailing edge 530 of each of the sheets 510 comprise an adhesive strip 540.

In some embodiments, the adhesive strip 540 comprises a series of discrete deposits of a re-adherable low-tack pressure sensitive adhesive that are spaced apart from one another. In some embodiments, the series of discrete deposits of a re-adherable low-tack pressure sensitive adhesive that are spaced apart from one another are comprised of circular shaped dots that are space apart from one another. In some embodiments, the series of discrete deposits of a re-adherable low-tack pressure sensitive adhesive that are spaced apart from one another are comprised of rectangularly shaped adhesive deposits that are space apart from one another.

When use, a user can easily pull a sheet 510*a* along the pre-perforated lines 520*a* from the roll 500 while the trailing edge 530*a* of that sheet 510*a* would be adhered to the sheet underneath 550*a* if the pulling force is greater than the adhesive force between the adhesive strip 540*a* and the sheet underneath 550*a*.

Once the sheet 510*a* is pulled off from the paper roll 500, the sheet 510*a* could be adhered to another surface by the adhesive strip 540*a*.

Figure 6A:
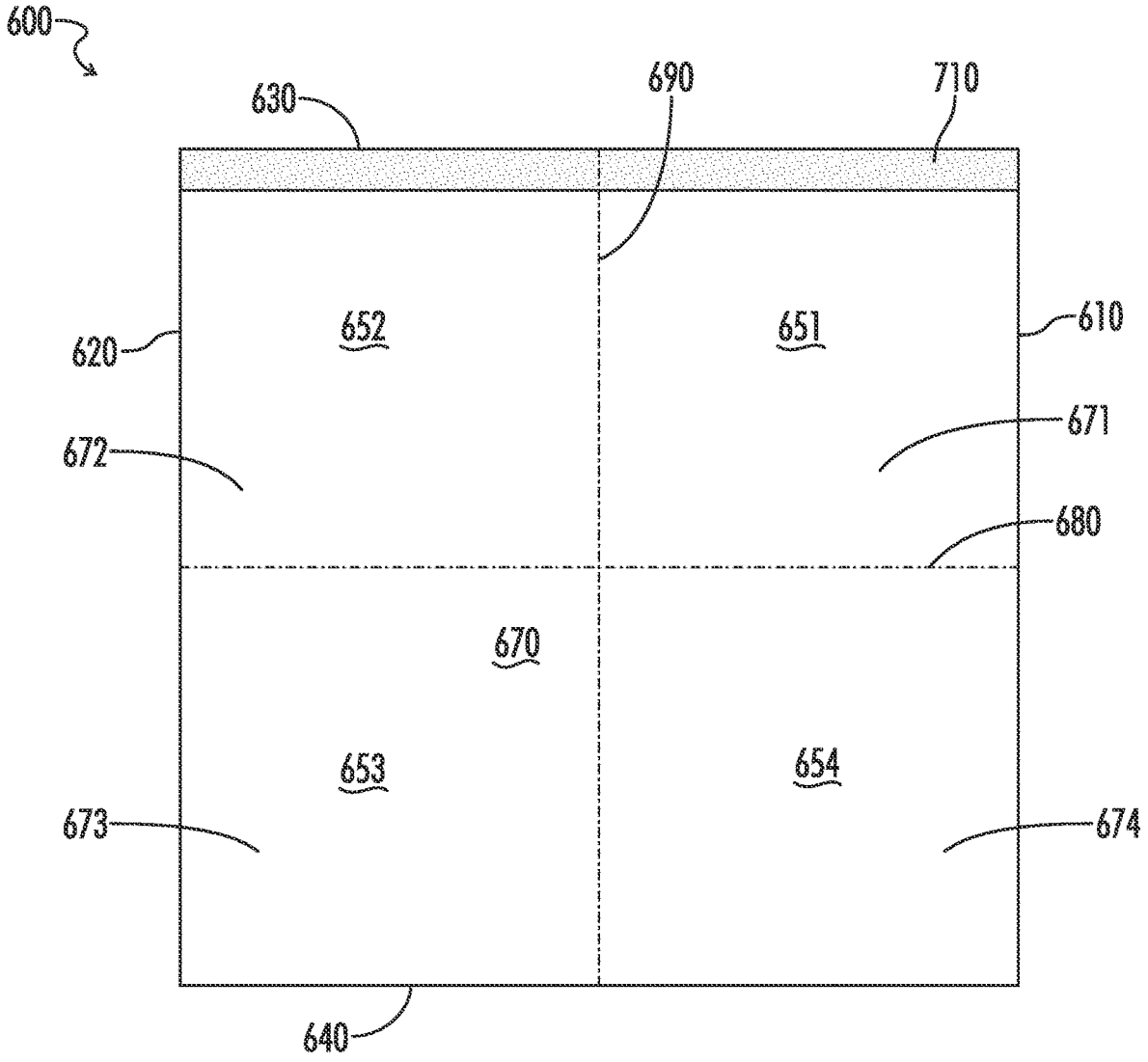
FIG. 6A is a perspective view of an embodiment of another representative implementation of a sticky napkin with the sticky napkin unfolded to show the outer surface.
Figure 7A:
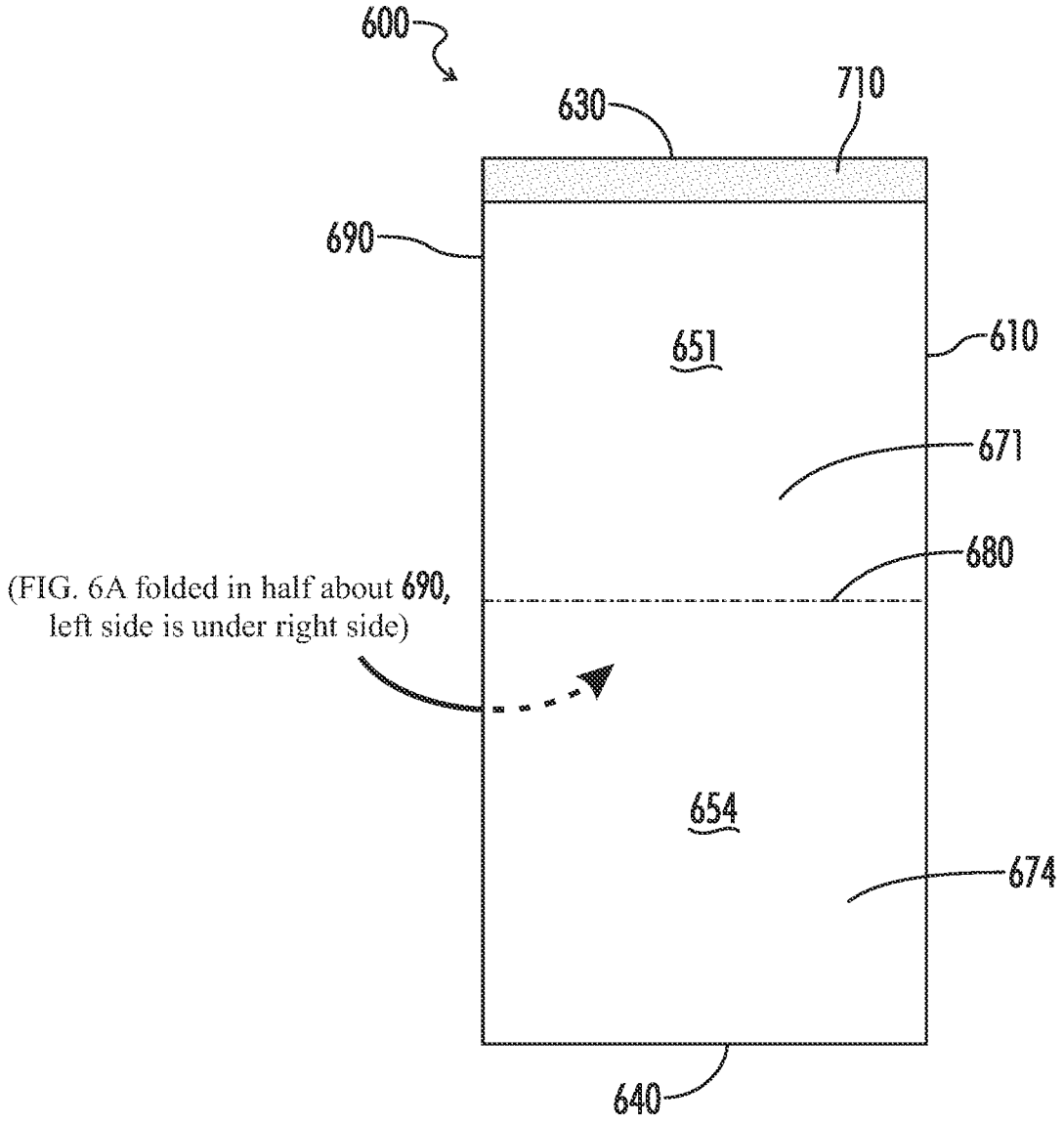
FIG. 7A is a perspective view of the sticky napkin of FIG. 6A with the sticky napkin folded in half along a fold line 690 to form a folded napkin.
Figure 7B:
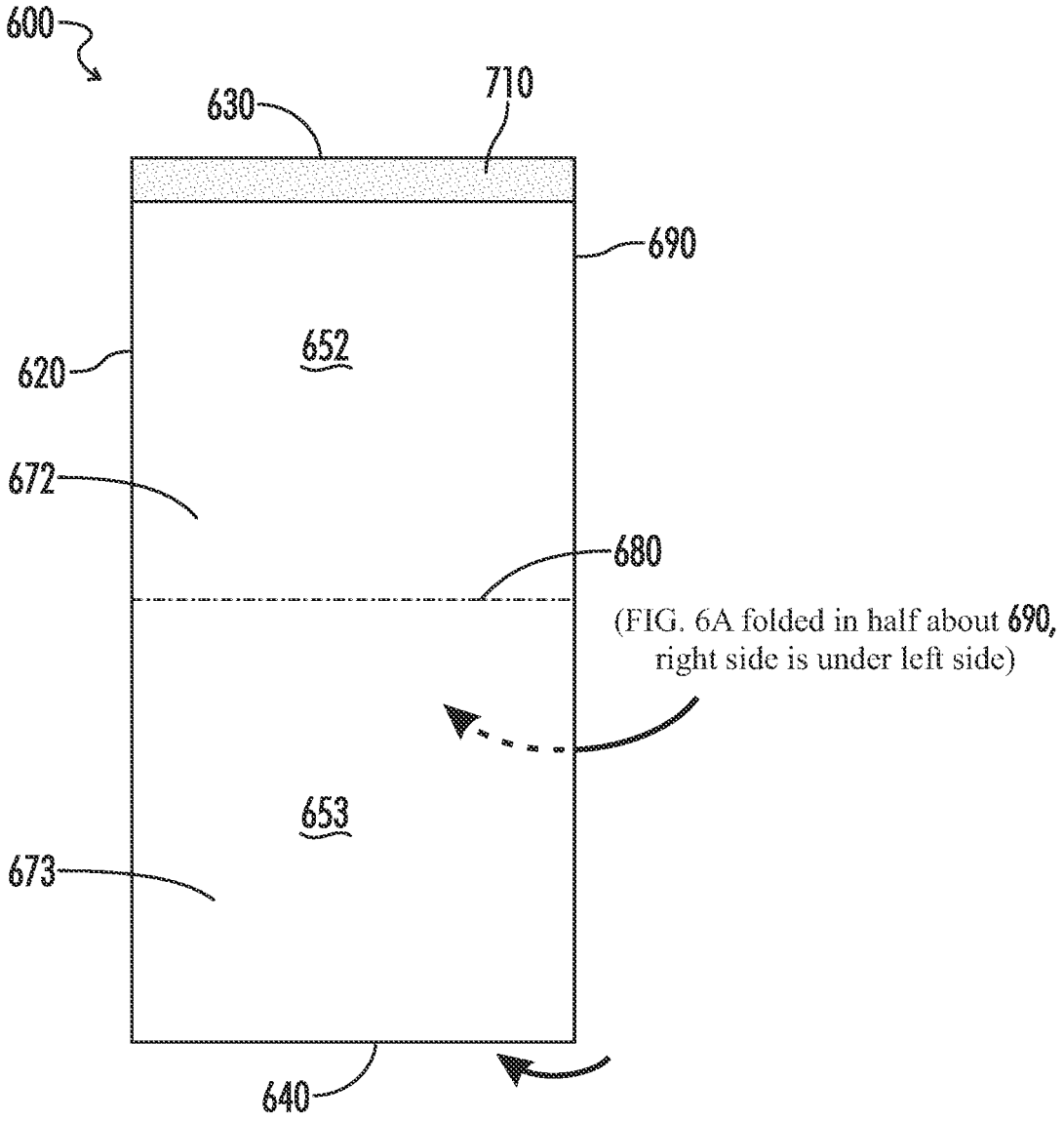
FIG. 7B is another perspective view of the sticky napkin of FIG. 6A with the sticky napkin folded in half along a fold line to form a folded napkin. It is a depiction of the opposite side of the folded napkin illustrated in FIG. 7A.
Figure 8A:
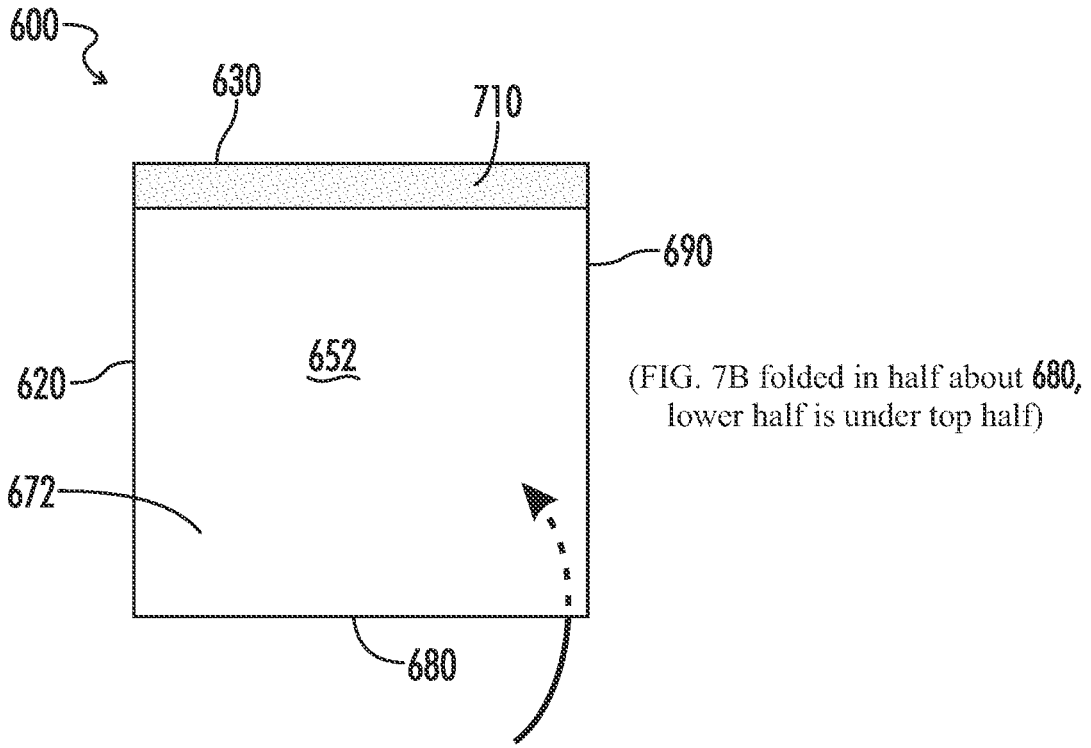
FIG. 8A is a perspective view of the sticky napkin of FIG. 7A with the sticky napkin folded further in half along another fold line 680 to form a double folded napkin.
Figure 8B:
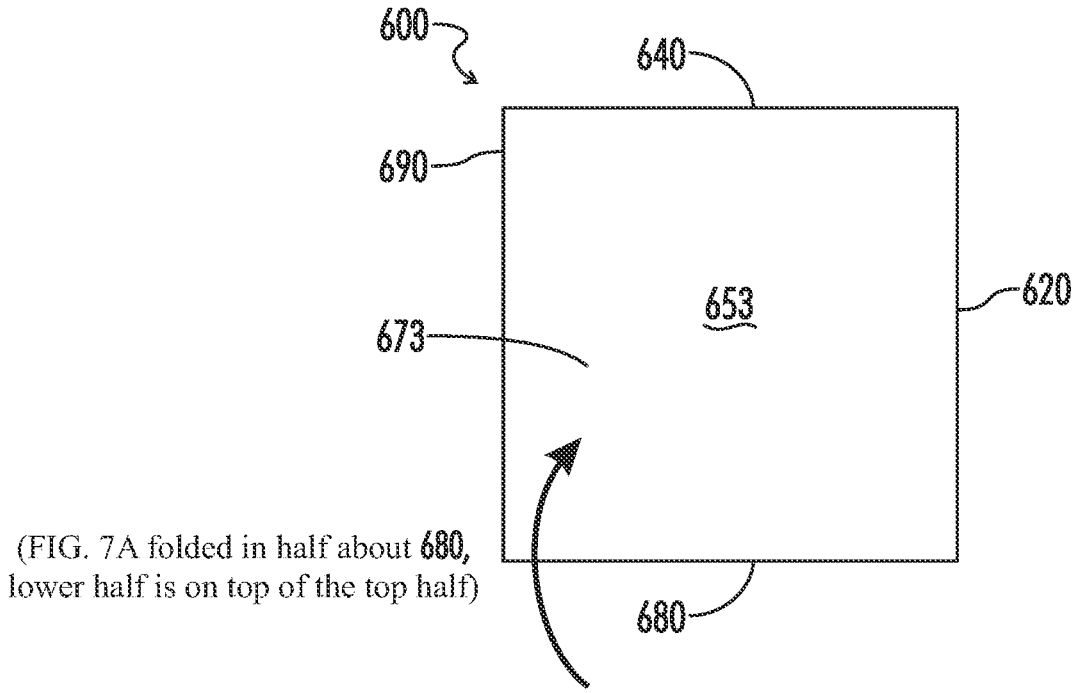
FIG. 8B is a depiction of the opposite side of the double folded sticky napkin illustrated in FIG. 8A.

Referring to FIGS. 6A-8B, the exemplary sticky napkin 600 can be a paper napkin pre-folded in four folds as shown in FIG. 8A and FIG. 8B. The exemplary sticky napkin 600 has an outer surface 670 defined by a first side 610, a second side 620, a third side 630 and a fourth side 640, as best shown in FIG. 6A.

The sticky napkin 600 can comprise a first fold line 680 extending from the first side 610 to the second side 620. The first fold line 680 can be substantially parallel to the third side 630 and the fourth side 640 with substantially the same distance from the third side 630 and the fourth side 640. The sticky napkin 600 further comprises a second fold line 690 extending from the third side 630 to the fourth side 640. The second fold line 690 can be substantially parallel to the first side 610 and the second side 620 with substantially the same distance from the first side 610 and the second side 620.

The first and second fold lines 680, 690 can divide the sticky napkin 600 into four quadrants with each quadrant corresponds to a section panel naming the first section panel 651, the second section panel 652, the third section panel 653, and the fourth section panel 654. In this configuration, the first fold line 680 separates the first section panel 651 and the second section panel 652 from the third section panel 653 and the fourth section panel 654, while the second fold line 690 separates the first section panel 651 and the fourth section panel 654 from the second section panel 652 and the third section panel 653.

The outer surface 670 can further be divided into four outer surface portions 671, 672, 673, 674 with each one of the four outer surface portions 671, 672, 673, 674 corresponds to one of the four section panels 651, 652, 653, 654, respectively.

Figure 6B:
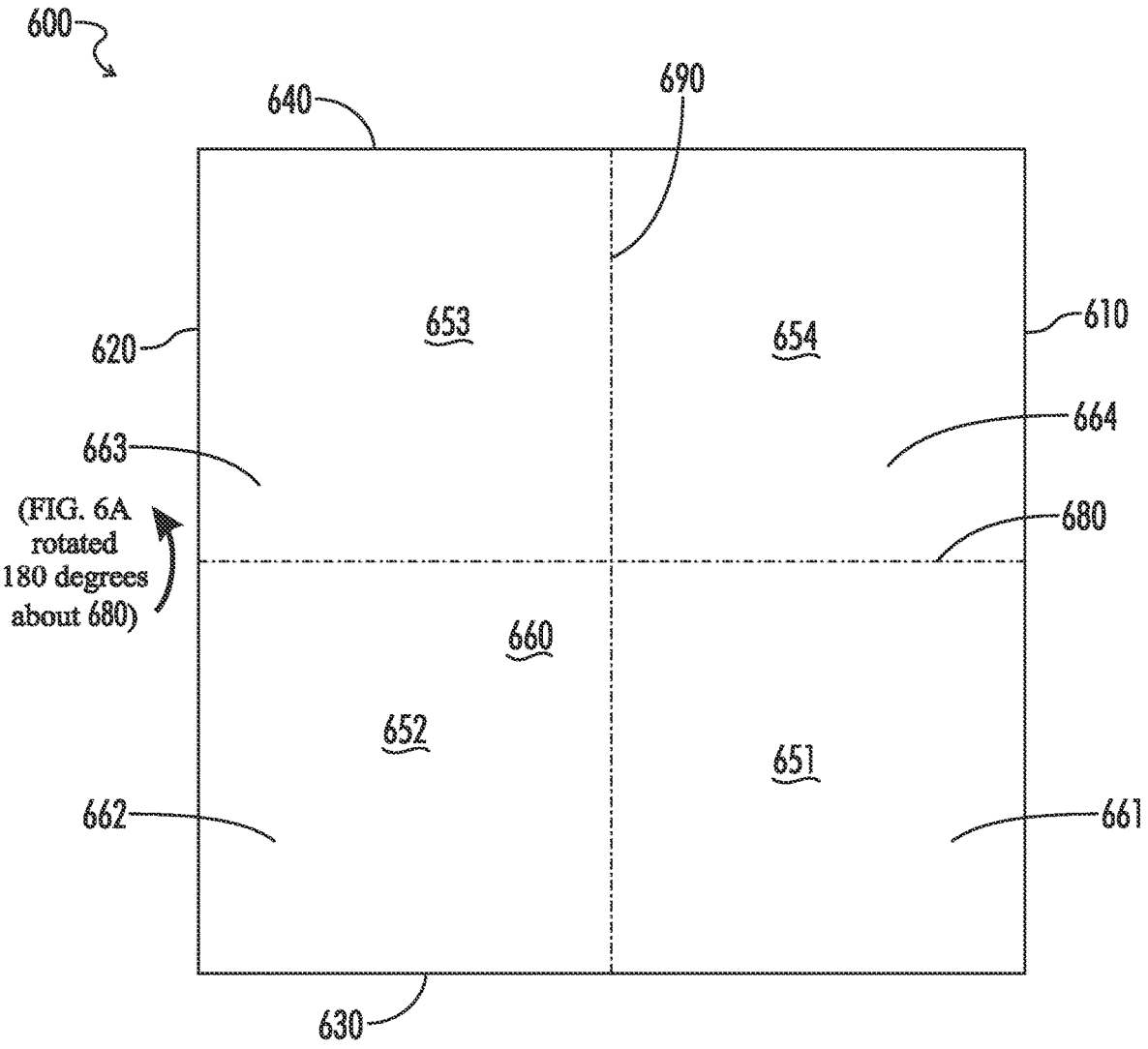
FIG. 6B is another perspective view of the sticky napkin of FIG. 6A with the sticky napkin unfolded to show the inner surface.

The exemplary sticky napkin 600 has an inner surface 660 that is opposing to the outer surface 670, as best shown in FIG. 6B, which is shown as a rotation of the sticky napkin 600 of FIG. 6A by 180° about fold line 680. The inner surface 660 can further be divided into four outer surface portions 661, 662, 663, 664 by fold lines 680, 690 with each one of the four inner surface portions 661, 662, 663, 664 corresponds to one of the four section panels 651, 652, 653, 654, respectively.

As best shown in FIG. 6A and FIG. 6B, the second fold line 690 is configured to bias the first section panel 651 and the fourth section panel 654 to fold over the second section panel 652 and the third section panel 653, as shown in FIG. 7A, such that the inner surface 661 of the first section panel 651 is facing the inner surface 662 of the second section panel 652 and the inner surface 663 of the third section panel 653 is facing the inner surface 664 of the fourth section panel 654 when folded. FIG. 7B is shown as a rotation of the sticky napkin 600 of FIG. 7A by 180° about fold line 690.

The sticky napkin 600 of FIG. 7A and FIG. 7B can be further folded along fold line 680 to form a double folded napkin as shown in FIG. 8A. FIG. 8B is shown as a rotation of the sticky napkin 600 of FIG. 8A by 180° about fold line 680.

A adhesive strip 710 can overlay the outer surface 671 of the first end section panel 651 and the outer surface 672 of the second end section panel 652 and extend in a direction from the first side 610 to the second side 620. The adhesive strip 710 can comprises a re-adherable low-tack pressure sensitive adhesive (PSA). The re-adherable low-tack pressure sensitive adhesive applied to adhesive strip 710 allow the outer surfaces 671, 672 to be easily attached to, removed from and even re-attached to other surfaces, e.g., paper, wood, metal, temporarily without lifting fibers or delaminating the sticky napkin 100.

In a pre-folded state, as shown in FIG. 7A and FIG. 7B, the adhesive strip 710 does not adhere to other portion of the sticky napkin 600. When the sticky napkin 600 is double folded as shown in FIG. 8A and FIG. 8B, the adhesive strip 710 adheres the outer surface 671 of the first section panel 651 to the outer surface 674 of the fourth section panel 654.

In some embodiments, the first side 610, second side 620, third side 630 and fourth side 640 define a contour of the sticky napkin 600 when the napkin is unfolded. In one embodiment, the contour of the sticky napkin 600 is a square. In another embodiment, the contour of the sticky napkin 600 is a rectangle.

In some embodiments, the adhesive strip 710 has varying dimensions. In some embodiments, the adhesive strip 710 extends to the first and second sides 610, 620. In some embodiments, the adhesive strip 710 does not extend to the first and second sides 610, 620.

In some embodiments, the adhesive strip 710 comprises a series of discrete deposits of a re-adherable low-tack pressure sensitive adhesive that are spaced apart from one another. In some embodiments, the series of discrete deposits of a re-adherable low-tack pressure sensitive adhesive that are spaced apart from one another are comprised of circular shaped dots that are space apart from one another. In some embodiments, the series of discrete deposits of a re-adherable low-tack pressure sensitive adhesive that are spaced apart from one another are comprised of rectangularly shaped adhesive deposits that are space apart from one another.

Figure 9:
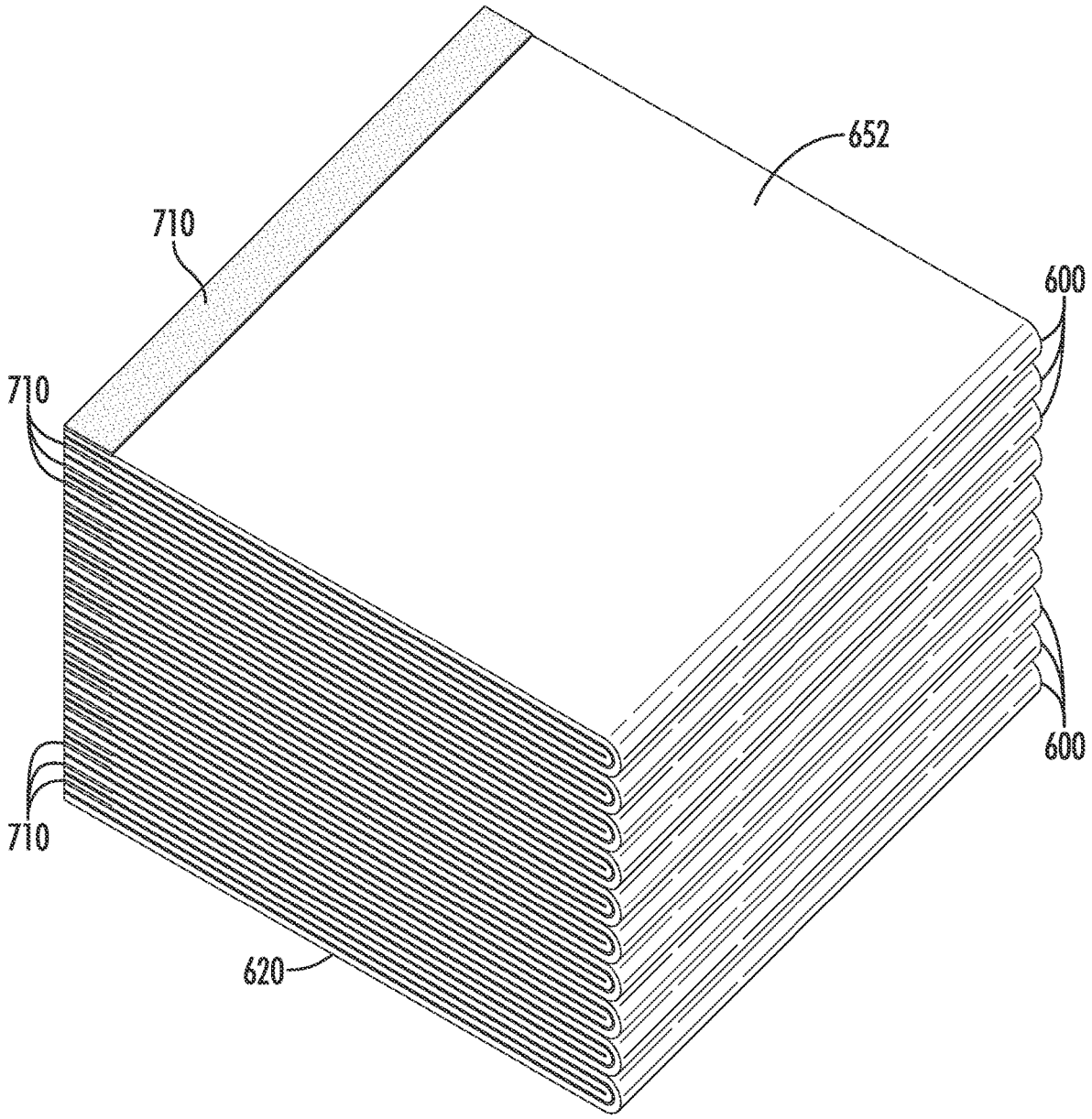
FIG. 9 is a perspective view of a stacked package of the double folded napkin illustrated in FIGS. 8A and 8B.

When the napkins 600 are placed in as a stacked package as best shown in FIG. 9, in some embodiments, the adhesive strip 710 on the outer surface 672 of the second panel 652 of one sticky napkin contained within the package is adhered to the outer surface 673 of the third panel 653 of an adjacent sticky napkin.

In some embodiments, the sticky napkin 600 is formed by 2-ply papers. In some embodiments, the sticky napkin 600 is formed by 3-ply papers. In some embodiments, the sticky napkin 600 is formed by 4-ply papers. In some embodiments, the sticky napkin 600 is made of recycled material.

In operation, in some embodiments, the sticky napkin 600 contained within a stacked package of pre-folded sticky napkins extending from a top sticky napkin to a bottom sticky napkin (as best shown in FIG. 9) can be obtained by detaching the outer surface 673 of the third section panel 653 of the top sticky napkin from the adhesive strip 710 of the underlying adjacent outer surface 672 of the second section panel 652.

In some embodiments, the sticky napkin 600 can be applied to an object or surface by applying pressure to the sticky napkin 600 against the object or surface to adhere the sticky napkin 600 to that object or surface via the adhesive strip 710 on the object or surface thereof.

In some embodiments, the sticky napkin 600 attached to one object or surface can be removed from the object or surface by removing the sticky napkin 600 from the object or surface and disposing the napkin in a waste container. In some embodiments, the removed sticky napkin 600 can be reattached to the same object or surface or to a new object or surface.

It should be understood that the scope of this disclosure includes the various combinations or sub-combinations of the specific features and aspects of the embodiments disclosed herein, such that the various features, modes of implementation and operation, and aspects of the disclosed subject matter may be combined with or substituted for one another. Structural and logical substitutions and changes may be made that fall within the scope of this disclosure, which is intended to cover any adaptations and variations of the particular implemented described herein and combination of the various features and component elements thereof.

The foregoing and various features, constructions, configurations, and aspects, together with those set forth in the claims and summarized above or otherwise disclosed herein, including the drawings, may alone or in any combination form claims for a device, apparatus, system, method of manufacture, and/or use without limitation. Thus, it is intended that the scope of the present invention herein disclosed should not be limited by the particular disclosed embodiments or implementations described above, but should be determined only by a fair reading of the claims.

What is claimed is:

1. A sticky napkin comprising a pre-folded paper napkin having a first surface and an opposing second surface with each surface defined by first, second, third and fourth sides, the first and second surfaces extending from a first end section panel to a second end section panel with a mid-section panel residing therebetween;

a first fold line extending from the first side to the second side;

a second fold line extending from the first side to the second side;

the first and second fold lines being spaced apart from one another, the first fold line separating the first end section panel from the mid-section panel of the napkin and the second fold line separating the second end section panel from the mid-section panel of the napkin;

the first fold line being configured to bias the first end section panel to fold over the mid-section panel such that the first surface of the first end section panel is facing the first surface of the mid-section panel when folded;

the second fold line being configured to bias the second end section panel to fold over the mid-section panel such that the first surface of the second end section panel is facing the surface of the mid-section panel when folded;

a first adhesive strip overlaying the second surface of the first end section panel and extending in a direction from the first side to the second side;

a second adhesive strip overlaying the second surface of the second end section panel and extending in a direction from the first side to the second side;

a third adhesive strip overlaying the second surface of the second end section panel and extending in a direction from the first side to the second side;

said first, second, and third adhesive strips each being comprised of a re-adherable low-tack pressure sensitive adhesive; and wherein in the pre-folded state, the first adhesive strip adheres the second surface of the first end section panel to the first surface of the second end section panel.

2. The sticky napkin of claim 1, wherein said first, second, third, and fourth sides define a square.

3. The sticky napkin of claim 1, wherein said first, second, third, and fourth sides define a rectangle.

4. The sticky napkin of claim 1, wherein said first, second and third adhesive strips have varying dimensions as compared to one another.

5. The sticky napkin of claim 1, wherein one or more of said first, second and third adhesive strips extend to said first and second sides.

6. The sticky napkin of claim 1, wherein one or more of said first, second and third adhesive strips do not extend to said first and second sides.

7. The sticky napkin of claim 1, wherein one or more of said first, second and third adhesive strips are comprised of series of discrete deposits of a re-adherable low-tack pressure sensitive adhesive that are spaced apart from one another.

8. The sticky napkin of claim 7, wherein the series of discrete deposits of a re-adherable low-tack pressure sensitive adhesive that are spaced apart from one another are comprised of circular shaped dots that are space apart from one another.

9. The sticky napkin of claim 7, wherein the series of discrete deposits of a re-adherable low-tack pressure sensitive adhesive that are spaced apart from one another are comprised of rectangularly shaped adhesive deposits that are space apart from one another.

10. A package of sticky napkins of claim 1, wherein said second and third adhesive strips of the sticky napkin contained within the package are adhered to the second surface of the mid-section panel of adjacent sticky napkin.

11. A package of sticky napkins of claim 10, wherein said second adhesive strip of the sticky napkin contained within the package is adhered to the second surface of the mid-section panel of an adjacent sticky napkin.

12. A method of using a sticky napkin of claim 10 contained within a stacked package of pre-folded sticky napkins extending from a top sticky napkin to a bottom sticky napkin comprising:

detaching the second surface of the mid-section panel of the top sticky napkin from the second and third adhesive strips of the underlying adjacent second surface of the second end section panel;

unfolding the top sticky napkin along its second fold-line to separate the second end-section panel from the first adhesive strip on the first end section panel and away from the mid-section panel;

unfolding the top sticky napkin along its first fold-line to separate the first end-section panel away from the mid-section panel;

applying pressure to the sticky napkin against a surface to adhere the sticky napkin to that surface via one or more of the adhesive strips on the surface thereof; and removing the sticky napkin from the surface and disposing the napkin in a waste container.

13. A sticky napkin comprising:

a pre-folded paper napkin having a first surface and an opposing second surface with each surface defined by first, second, third and fourth sides, the first and second surfaces extending from a first end section panel to a second end section panel with a mid-section panel residing therebetween;

a first fold line extending from the first side to the second side;

a second fold line extending from the first side to the second side;

the first and second fold lines being spaced apart from one another, the first fold line separating the first end section panel from the mid-section panel of the napkin and the second fold line separating the second end section panel from the mid-section panel of the napkin;

the first fold line being configured to bias the first end section panel to fold over the mid-section panel such that the first surface of the first end section panel is facing the first surface of the mid-section panel when folded;

the second fold line being configured to bias the second end section panel to fold over the mid-section panel such that the first surface of the second end section panel is facing the surface of the mid-section panel when folded;

a first adhesive strip overlaying the second surface of the first end section panel and extending in a direction from the first side to the second side;

a second adhesive strip overlaying the second surface of the second end section panel and extending in a direction from the first side to the second side;

said first and second adhesive strips each being comprised of a re-adherable low-tack pressure sensitive adhesive; and wherein in the pre-folded state, the first adhesive strip adheres the second surface of the first end section panel to the first surface of the second end section panel.

14. The sticky napkin of claim 13, wherein said first, second, third, and fourth sides define a square.

15. The sticky napkin of claim 13, wherein said first, second, third, and fourth sides define a rectangle.

16. The sticky napkin of claim 13, wherein said first and second adhesive strips have varying dimensions as compared to one another.

17. The sticky napkin of claim 13, wherein one or more of said first and second adhesive strips extend to said first and second sides.

18. The sticky napkin of claim 13, wherein one or more of said first and second adhesive strips do not extend to said first and second sides.

19. The sticky napkin of claim 13, wherein one or more of said first and second adhesive strips are comprised of series of discrete deposits of a re-adherable low-tack pressure sensitive adhesive that are spaced apart from one another.

20. The sticky napkin of claim 19, wherein the series of discrete deposits of a re-adherable low-tack pressure sensitive adhesive that are spaced apart from one another are comprised of circular shaped dots that are space apart from one another.

21. The sticky napkin of claim 19, wherein the series of discrete deposits of a re-adherable low-tack pressure sensitive adhesive that are spaced apart from one another are comprised of rectangularly shaped adhesive deposits that are space apart from one another.

* * * * *